US006354889B1

(12) United States Patent
Matsuda et al.

(10) Patent No.: US 6,354,889 B1
(45) Date of Patent: Mar. 12, 2002

(54) MULTIPLE-THREADED TERMINAL DEVICE

(75) Inventors: Takeshi Matsuda; Nobuyuki Mano; Masamitsu Ogawa, all of Tokyo (JP)

(73) Assignee: SMK Corporation (JP)

( * ) Notice: Subject to any disclaimer, the term of this patent is extended or adjusted under 35 U.S.C. 154(b) by 0 days.

(21) Appl. No.: 09/711,032

(22) Filed: Nov. 13, 2000

Related U.S. Application Data

(63) Continuation of application No. PCT/JP00/00751, filed on Feb. 10, 2000.

(30) Foreign Application Priority Data

Oct. 12, 1999 (JP) ..... 11-288999

(51) Int. Cl.[7] ..... H01R 4/30; H01R 4/38; H01R 9/22

(52) U.S. Cl. ..... 439/801; 439/721; 439/727

(58) Field of Search ..... 439/801, 320, 439/327, 805, 353, 712, 722, 724, 744, 746, 721, 727

(56) References Cited

U.S. PATENT DOCUMENTS 5,186,644 A * 2/1993 Pawlicki et al. ..... 439/353

FOREIGN PATENT DOCUMENTS

| | | |
|---|---|---|
| JP | 4967532 | 1/1976 |
| JP | 54104087 | 7/1979 |
| JP | 53115822 | 3/1980 |

* cited by examiner

*Primary Examiner*—Brian Sircus
*Assistant Examiner*—Chandrika Prasad
(74) *Attorney, Agent, or Firm*—Morrison Law Firm

(57) ABSTRACT

A body plate receives a knob, retained in the body plate by a simplified terminal, to form a complete multiple-threaded terminal device. Each terminal firmly fixes into the body plate by locking into integrally formed stage portions. Each knob is retained by the snap-in terminal and preventative elements formed integrally in both the body plate and the rotating control. In a second embodiment, a body plate receives a knob and a terminal, each retained in the body plate by a rear cover, to form a complete multiple-threaded terminal device. Each rear cover firmly fixes into the body plate by locking in an integrally formed peripheral frame. Each knob is retained by the snap-in rear cover and preventative elements formed integrally with both the body plate and the rotating control.

14 Claims, 14 Drawing Sheets

PRIOR ART

MULTIPLE-THREADED TERMINAL DEVICE

This application is a continuation of PCT/JP00/00751 filed Feb. 10, 2000.

BACKGROUND OF THE INVENTION

1. Field of the Invention

The present invention relates to a multiple-threaded terminal device for use in electrical systems, particularly in audio and video systems.

2. Description of the Related Art

Referring to FIG. 14, a conventional multiple-threaded terminal device, shown generally at 100", includes an electrically conductive terminal section 14, with terminal section 14*a*, mounted on an insulative body plate 1. A rotating handle 6 is mounted projecting away from a first surface of body plate 1. Rotating handle 6 rotates toward body plate 1 to secure a lead wire (not shown) within a lead-wire-inserting recess 2 formed in an outer wall of a lead-wire-connecting section 3.

Additionally referring to FIG. 15, conventional multiple-threaded terminal device 100" includes an electrically conductive terminal plate 4 mounted to body plate 1. A conventional terminal 15' is secured to body plate 1 by a threaded shaft section 7, threaded through a tap hole 8 in terminal plate 4. Rotating handle 6, affixed projecting away from terminal plate 4, enables screwing and unscrewing of threaded shaft section 7 for making electrical connection, as will be explained. Conventional multiple-threaded terminal devices 100", are generally constructed in a four-gang (not shown), or eight-gang (shown later) configuration.

Body plate 1 contains lead-wire-connecting sections 3. Lead-wire-connecting sections 3 are formed on the first surface of body plate 1 and surround part of terminal bodies 15' near the first surface of body plate 1. Lead-wire-connection sections 3 help avoid lead wire shorts and reduce the chance of electrical contact with a person or an object. Lead-wire-connection sections 3 have lead-wire-inserting recess 2 in an outer periphery.

A through hole 16 accommodates adjustable threaded shaft section 7 of terminal body 15'. Threaded shaft section 7 is centered in cylindrical lead-wire-connection section 3. Around through hole 16, one or more fixing holes(not shown) permit insertion of one or more folding pieces 13 and terminal piece 14, of terminal plate 4, to fix terminal plate 4 firmly into insulative body plate 1.

Terminal body 15' has cylindrical rotating handle 6 fixed around a rod-shaped contact 5 with a plug insertion hole 10 for receiving a banana tip plug 12 or other suitable contact wire. Plug insertion hole 10 is formed on a first side of a lead-wire-pinching section 9 and rotating handle 6 is firmly fixed around terminal body 15' by a flange form 11 formed opposite the lead-wire-pinching section 9 by curl clamping.

Rotating handle 6 is generally cylindrical in shape. A fit hole 18, shaped to receive contact 5, passes through the center of rotating handle 6. A plug insertion opening 17, having a diameter greater than that of fit hole 18 is formed at the top of fit hole 18. A recess(not shown) at the bottom of fit hole 18 receives lead-wire-pinching section 9.

Lead-wire-pinching section 9 is pulled into stabilizing contact with terminal plate 4 when threaded shaft section 7 is tightened. Rotating handle 6 is formed from an electrically insulative material such as resin. Terminal body 15' accepts the press fit rotating handle 6 to provide a safer and greater gripping surface for an operator.

During assembly, terminal section 14*a*, on terminal piece 14 of terminal plate 4, is inserted into lead-wire-connecting sections 3 from above and slipped partially into through holes 16. Further insertion requires rotating terminal pieces 14, fashioned in the form of a circular arc, including terminal sections 14*a*, to allow free passage through lead-wire-connection sections 3. As terminal pieces 14 protrude through a second surface of body plate 1, folding pieces 13 engage respective fixing holes (not shown) in body plate 1 and a bottom surface of terminal plate 4 rests directly against a top surface of body plate 1.

After integration of terminal plates 4 and terminal pieces 14, into body plate 1, terminal bodies 15' are threaded into tap holes 8. When each threaded shaft section 7 is tightened, an end portion of threaded shaft section 7 protrudes below the second surface of body plate 1. After tightening, the end portion of threaded shaft section 7 is crushed and deformed to form crushed portion 19 and disrupt a continuous helical thread formed on threaded shaft section 7. Crushed portion 19 thus prevents terminal body 15' from disengaging tap hole 8, or from being lost during later adjustment.

Once terminal bodies 15' with rotating handles 6 are connected to body plate 1, rotating handles 6 are loosened sufficiently to allow insertion of at least one lead wire(not shown) through lead-wire-insertion recesses 2. When threaded shaft portion 7 of each terminal body 15' is tightened toward tap hole 8 in terminal plate 4, the bottom surface of lead-wire-pinching section 9 and a top surface of terminal plate 4 sandwich the lead wire(not shown) for electrical contact. More than one lead wire(not shown) may be captured this way, and connected to a connector inserted into plug insertion hole 10 or terminal piece 14.

Referring additionally to FIG. 16, multiple terminal bodies 15' with rotating handles 6 may be positioned on conventional multiple-threaded terminal device 100" in an eight-gang configuration. As shown, terminal pieces 14, with terminal sections 14*a*, extend beyond the periphery of body plate 1 to provide easy electrical contact.

The current design of multiple-threaded terminal device 100" creates several manufacturing difficulties. First, it is difficult to automate the step of integrating terminal plate 4, with folding pieces 13, into body plate 1. The curved circular-arc portions, of terminal pieces 14, require insertion in conformity with their radius. Additionally, where customer needs dictate a large length for terminal pieces 14, the radius of curvature during instillation is correspondingly large, thereby increasing the complexity of the instillation process. Also additionally, where the lateral projection length of terminal 14 is large, the radius of curvature of the circular arc is correspondingly large, as a result, the terminal piece 14 is projected far from of the bottom surface of the body plate 1, thereby increasing the size of the overall multiple-threaded terminal device 100".

Second, since terminal plate 4 is fixed into the body plate 1 by press-fitting folding pieces 13 into fixing holes(not shown), an strong pressurization step is required and this increases both the duration of the instillation process and the complexity of the instillation process.

Third, the crushing step forming crushed portions 19, must be performed after terminal plates 4 and terminal bodies 15' are installed into body plate 1. As a result, performing the crushing step is inconvenient and increases manufacturing time and cost. In an eight-gang multiple-threaded terminal device 100", the crushing step is particularly cumbersome and repetitive.

Fourth, during assembly of multiple-threaded terminal device 100" in general, and particularly during the crushing step forming crushed portions 19, damage may occur to any exposed parts. Specifically, exposed terminal pieces 14 with terminal sections 14*a* are susceptible to machine or operator error.

OBJECTS AND SUMMARY OF THE INVENTION

It is an object of the present invention is to provide a multiple-threaded terminal device where automated assembly is easy.

It is another object of the present invention to provide a multiple-threaded terminal device of a smaller size requiring correspondingly smaller instillation space.

It is another object of the present invention to provide a multiple-threaded terminal device having an improved assembly time and a lower defect rate.

It is another object of the present invention to provide a multiple-threaded terminal device that minimizes the risk of detritus interfering with electrical connection.

It is another object of the present invention to provide a multiple-threaded terminal device that retains threaded connection between a threaded portion and a terminal to prevent thread disengagement.

It is another object of the present invention to provide a multiple-threaded terminal device minimizing lower raw material and construction costs.

It is another object of the present invention to provide a multiple-threaded terminal device having a terminal of simplified construction thereby reducing supplier formation steps for the terminal and other device parts involved.

It is another object of the present invention to provide a multiple-threaded terminal device having a body plate with increased resistance to fracture and damage during assembly thereby reducing replacement costs and down time.

It is another object of the present invention to provide a multiple-threaded terminal device having simplified sub-assembly units thereby facilitating faster sub-assembly, easier storage of sub-assembly units, and lowered manufacturing costs.

The present invention relates to a multiple-threaded terminal device wherein a body plate receives multiple rotating controls, each retained in the body plate by a simplified terminal, to form a complete multiple-threaded terminal device. Each terminal firmly fixes into the body plate by locking into integrally formed stage portions. Each rotating control is retained by the snap-in terminal and preventive elements formed integrally with both the body plate and the rotating control. In a second embodiment, a body plate receives multiple rotating controls and multiple terminals, each retained in the body plate by a rear cover, forming a complete multiple-threaded terminal device. Each rear cover firmly fixes into the body plate by locking into an integrally formed peripheral frame. Each rotating control is retained by the snap-in rear cover and preventive elements formed integrally with both the body plate and the rotating control.

According to an embodiment of the present invention there is provided a multiple terminal device comprising: a body plate, the body plate including at least one rotating control projecting from a first surface, the body plate including a housing section surrounding the control and extending away from the first surface, the control including means for attachment to a first external element, the means for attachment on a first end of the control, the control including means for adjustment relative to the first external element, the means for adjustment on a second end of the control, and the body plate including means for aligning and fixing the first external element to the body plate between the first surface and a second surface.

According to another embodiment of the present invention there is provided a multiple terminal device wherein: the adjustment means includes an integral cylindrical control section, the control section containing at least one non-slip groove, and the non-slip groove enabling manual adjustment of the control relative to the first external element.

According to an embodiment of the present invention there is provided a multiple terminal device wherein: the means for aligning and fixing includes at least one recessed groove and at least one stage section and at least one stage portion, the recessed groove between the first and the second sides parallel to the rotating control, the recessed groove engaging at least one guide portion formed on the first external element to prevent rotation of the first external element relative to the first surface, the stage section formed intermediate to the recessed groove and the first surface parallel to the first surface, the stage section engaging a top portion of the first external element to align the first external element relative to the first surface, the stage portion formed intermediate to the recessed groove and the second surface parallel to the second surface, and the stage portion engaging a stopper portion of the first external element to fix the first external element in the body plate.

According to an embodiment of the present invention there is provided a multiple terminal device comprising: a contact, means on a first end of the contact for attachment to a first external element, means on the second end of the contact for attachment to second external element, a control portion formed around the second end of the contact, the control portion having an exterior surface, at least one groove portion on the exterior surface of the control section, and the groove portion enabling manual manipulation of the contact relative to the first external element.

According to an embodiment of the present invention there is provided a multiple terminal device comprising: a terminal, the terminal including a terminal plate, the terminal plate including a threaded portion permitting threaded attachment to a first external element, the terminal including at least one guide portion extending horizontally from the terminal plate, the guide portion providing flanged contact to a second external element, the flanged contact aligns the terminal to the second external element, the guide portion also including at least one folded piece extending perpendicular to the terminal plate, the folded piece including an elastic stopper piece, the stopper piece elastically fixes the terminal to the second external element to retain the terminal within the second external element, at least one the folded piece extending away from the second element to a distal end, and the distal end enabling electrical connection from the first external element through the terminal to the distal end.

According to an embodiment of the present invention there is provided a multiple terminal device comprising: a body plate, the body plate having a through hole extending from the first surface to a second surface and engaging the first external element, at least one recessed groove formed between the first and the second surfaces perpendicular to the first surface resists relative rotation of the first external element relative to the body plate, at least one stage section formed between the recessed groove and the first surface parallel to the first surface aligns the first external element to the first surface, and at least one stage portion formed integral to the body plate fixes the first external element parallel to the first surface.

According to an embodiment of the present invention there is provided a multiple terminal device comprising: a body plate, the body plate having a first surface and a second surface, the body plate including at least one housing section surrounding a through hole and extending away from the first surface, the housing section includes a plate section within the housing section, the plate section aligning a first external element parallel to the first surface, the first external element threadably engaging a rotating control, at least one stage section formed between the first and second surfaces parallel to the first surface, the stage section aligning a second external element to the first external element and to the body plate, the body plate includes a frame portion between the first and the second surface; the frame portion includes at least one stage section, and the stage section replaceably fixes the second external element to the body plate thereby fixing the first external element in the housing section.

According to an embodiment of the present invention there is provided a multiple terminal device wherein the first external element further comprises: a terminal, the terminal including a terminal plate having a rim portion, the terminal plate including a threaded portion for threadably engaging a rotating control, a terminal section extending from the terminal plate, the terminal section extending between the first surface and the second surface to the peripheral frame, and the terminal section enabling electrical connection from the terminal section through the terminal plate to the rotating control. According to an embodiment of the present invention there is provided a multiple terminal device wherein the second external element further comprises: a rear cover, the rear cover including at least one supporting projection, the supporting projection extending into the housing section to support the first external element away from the first surface, the rear cover including at least one spring piece, the spring piece extends away from the rear cover in an elastic form, the spring piece extending in an engaging portion perpendicular to the rear cover, the engaging portion snaps into the stage section and retains the supporting projection within the housing section to fix the first external element within the body plate, and the rear cover being adapted to allow terminal portions of the first external element to pass between the first and the second surface to an outer edge of the body plate.

According to an embodiment of the present invention there is provided a multiple terminal device comprising: a body plate, the body plate including a plurality of rotating controls projecting from a first surface, each rotating control including a rod-shaped contact secured along a central axis thereof, each contact including an intermediate lead-wire pinching member and means on a first end for adjustable attachment to a first external element, each contact including a grooved control section a second end for operator adjustment relative to the first external element, the contact including means on the second end for attachment to a second external element, the body plate including a generally circular housing section surrounding each the rotating control and extending away from the first surface, the housing section having a first preventive means formed on a top radius parallel to the first surface, and the first preventive means engaging a second preventive means formed on each the contact thereby preventing passage of the contact away from the first surface.

According to an embodiment of the present invention there is provided a multiple terminal device wherein: the housing section surrounds a through hole extending through the body plate from the first surface to a second surface, the housing section and the through hole having a common central axis through the body plate, the housing section including an alignment portion formed on an interior surface about the central axis, the housing sections receive the rotating controls and the first external elements through the second surface, and the alignment portions align the first external elements to the body plate.

According to an embodiment of the present invention there is provided a multiple terminal device wherein: the first external element is a terminal, the terminal including a terminal plate having a threaded portion permitting threaded attachment to the rotating control, the terminal having a plurality of guide portions extending into the body plate and aligning with the alignment portions, the terminal having integral stopper pieces formed in a periphery there of perpendicular to the terminal plate, the body plate having stage portions formed in each through hole below each housing section, and the stopper pieces snapping into the stage portions to fix each the terminal and each the rotating control in the housing section.

According to an embodiment of the present invention there is provided a multiple terminal device wherein: each first external element is a terminal, the terminal including a terminal plate having a threaded portion permitting threaded attachment to the rotating control, the terminal plate aligning with the alignment portions, the body plate having a peripheral rim formed perpendicular to the first surface, the peripheral rim including stage sections formed parallel to the first surface, a rear cover, the rear cover including at least one supporting projection and at least one spring piece containing an engaging claw, the supporting projection supporting the terminal against the alignment portions, and the engaging claws fixing the rear cover to the body plate to retain the rotating control within the housing section.

The above, and other objects, features and advantages of the present invention will become apparent from the following description read in conjunction with the accompanying drawings, in which like reference numerals designate the same elements.

DETAILED DESCRIPTION OF THE INVENTION

Figure 1:
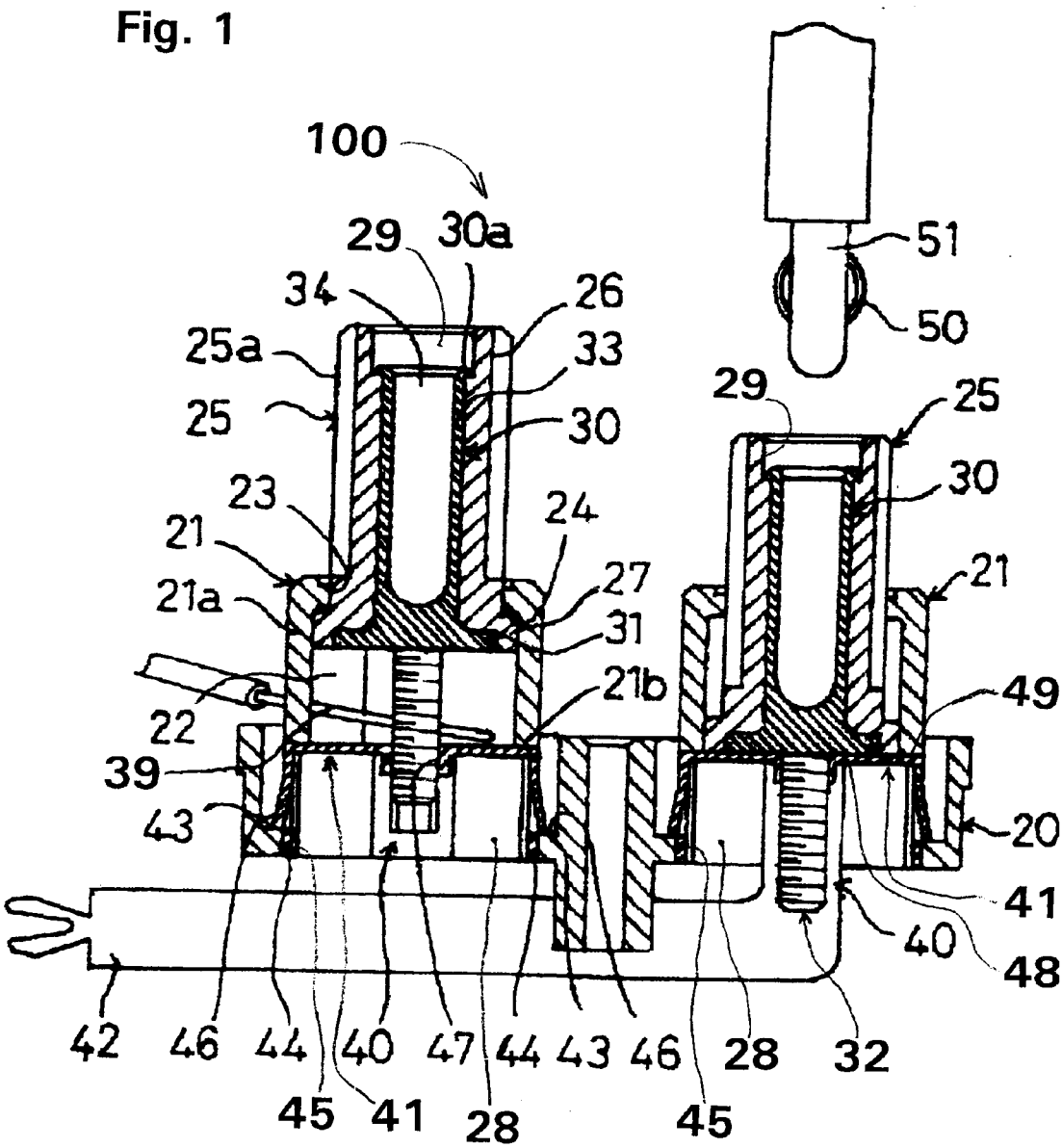
FIG. 1 is a sectional view, taken along line A—A in FIG. 2, of a first embodiment of a multiple-threaded terminal device.

Referring to FIG. 1, a first embodiment of a multiple-threaded terminal device, shown generally at 100 includes an electrically conductive terminal 40 mounted on an electrically insulative body plate 20. A rotatable knob 25 is secured to terminal 40 by a threaded shaft section 32 threaded into a threaded hole 47 formed in terminal 40. A cylindrical control section 25*a*, fixed projecting away from rotatable knob 25, enables screwing and unscrewing of threaded shaft section 32, as will be explained. Rotatable knob 25 serves as a rotating control for threaded shaft section 32.

A housing section 21, surrounds part of rotatable knob 25, and helps to avoid lead wire shorts and reduces the chance of electrical contact with a person or an object. Housing section 21 is formed cylindrically about a center axis and has at least one lead wire insert hole 22 in its outer periphery to receive a lead wire 39. Housing section 21 includes a projecting cylindrical portion 21*a* extending away from a first surface of body plate 20. Projecting cylindrical portion 21*a* has a control-inserting-and-passing opening 23 formed about the center axis at a top portion. A peripheral rim portion, constituting a control-locking section 24 surrounds and defines inserting-and-passing opening 23.

Control-locking section 24 extends radially about the central axis and, combined with a stopper projection 27, prevents rotatable knob 25 from passing away from the first surface of body plate 20, as will be explained. Extending below the first surface of body plate 20, relative to the page, housing section 21 contains at least one stage section 21*b* for aligning and retaining terminal 40, as will be additionally explained. Multiple-threaded terminal devices 100 may be in a four-gang or eight-gang or other configuration.

Each rotatable knob 25 comprises a contact 30 made from an electrically conductive material, such as metal. Each contact 30 has an intermediate flange-shaped-lead-wire-pinching member 31 projecting radially from a central axis. Around the central axis of rotating control 30 is formed a contact-plug-insertion hole(not shown) containing a control-penetrating shaft section 33 formed on a first side of lead-wire-pinching member 31. A recess at the bottom of cylindrical control section 25*a* engages lead-wire-pinching member 31. Threaded shaft section 32 extends on a second side of lead-wire-pinching member 31 and allows threaded engagement with terminal 40.

Electrically conductive contact 30 is an element with control penetrating shaft 33 at a first end, and threaded shaft section 32 at a second end. Control penetrating shaft 33 surrounds an axial plug inserting hole 34 to enable the insertion and electrical connection to a plug 51 having contact springs 50 to engage an inner diameter of plug insertion hole 34.

Excluding electrically conductive contact 30, rotatable knob 25 is constructed from a synthetic resin material, and surrounds control penetrating shaft 33. Rotatable knob 25 has a generally cylindrical shape coaxial to the axis of contact 30. On a top side of rotatable knob 25 is formed a cylindrical control section 25*a* having at least one nonslip grove 26 formed on an outer surface and a plug-insertion opening 29. Nonslip grove 26 aids operators in establishing a secure grip on the rotatable knob 25.

Stopper projection 27 surrounds the bottom side of rotatable knob 25. Stopper projection 27, has an outer diameter greater than that of lead-wire-pinching member 31. Stopper projection 27 covers and fixes lead wire pinching member 31, as will be explained.

The outer diameter of stopper projection 27 is less than an inner diameter of cylindrical portion 21*a* to enable rotating adjustment. The outer diameter of stopper projection 27 is greater than an inner diameter of locking-control portion 24 of control-inserting-and-passing opening 23 thereby blocking the passage of rotatable knob 25 away from the first surface of body plate 20.

During assembly of rotatable knob 25, contact 30 is inserted in the contact-plug insertion hole (not shown) formed centrally in rotatable knob 25. After insertion, a top portion of control-penetrating shaft 33 is curl-clamped or swaged to form a flange-shaped curl section 30*a* within plug insertion opening 29.

Plug insertion opening 29 has a larger inner diameter than the outer diameter of control-penetrating shaft 33. Plug insertion opening 29 receives curl section 30*a* to fix contact 30 into cylindrical control section 25*a*, thereby forming rotatable knob 25. This integration prevents contact 30 and cylindrical control section 25*a* from rotating relative to each other and from losing contact with each other as rotatable knob 25 adjusts.

Through holes 28 are formed in the second surface of body plate 20. Through holes 28 have a diameter larger than the inner diameter of cylindrical housing section 21 but smaller than the outer diameter of cylindrical housing section 21, thus forming stage section 21*b*. Stage section 21*b* is formed at the lower end of the projecting cylindrical portion 21*a* and serves to position terminal 40 below cylindrical portion 21*a*.

Also formed around through holes 28, generally between the second surface of body plate 20 and cylindrical portions 21*a*, are a plurality of recessed grooves 45. Each recessed groove 45 is formed on an inner surface of each through hole 28 and extends, parallel to the central axis, to the bottom of cylindrical portions 21*a*. Each recessed groove 45 includes a stage portion 46, formed as a horizontal surface in an intermediate position on recessed groove 45. Recessed grooves 45 serve to align and guide terminals 40, parallel to housing section 21, during assembly, as will be explained. Also during assembly, stage portions 46, acting with recessed grooves 45 and cylindrical portions 21*a*, serve to fix terminals 40 within through holes 28, as will be explained.

Each terminal 40, formed integrally of an electrically conductive material such as metal, contains a generally cylindrical terminal plate 41 having centrally formed threaded hole 47. Threaded hole 47 enables threaded electrical contact between rotatable knob 25, with threaded shaft section 32, and terminal 40. Terminal plate 41, of terminal 40, has an outer rim having a diameter fitting within through hole 28, and a centrally located contact portion 48. Contact portion 48 is a region on a top face of terminal plate 41 corresponding to a bottom face of lead-wire-pinching member 31. Contact portion 48 enables electrical contact between the bottom face of lead-wire-pinching member 31 and the top face of terminal plate 41, as will be explained.

Guide portions 49 are formed along the outer rim of terminal plate 41 extending away from threaded hole 47. Each guide portion 49 extends from terminal plate 41 and engages a front edge and sides of each corresponding recess groove 45 thereby aligning terminal 40 with housing section 21. Each guide portion 49 extends perpendicularly from terminal plate 41 to form a folded piece 44.

Folded pieces 44 extend away from terminal plate 41 toward the second surface of body plate 20. At lease one of the folded pieces 44 extends as a terminal section 42 positioned below the second surface of body plate 20. Terminal section 42 has a distal end enabling electrical contact between the distal end and the terminal plate 41. Terminal section 42 may be of variable lengths depending upon manufacturing or customer demands.

Each folded piece 44 has an erect stopper piece 43, formed from the folding piece 44. Stopper pieces 43 are elastically bent away from the central axis and are formed to fit within corresponding stage portions 46 to fix terminal 40 within body plate 20. The horizontal surface of each stage portion 46 fixes a tip of each stopper piece 43 and holds terminal plate 41 against stage section 21*b* thus preventing easy removal of terminal 40 from body plate 20.

Figure 2:
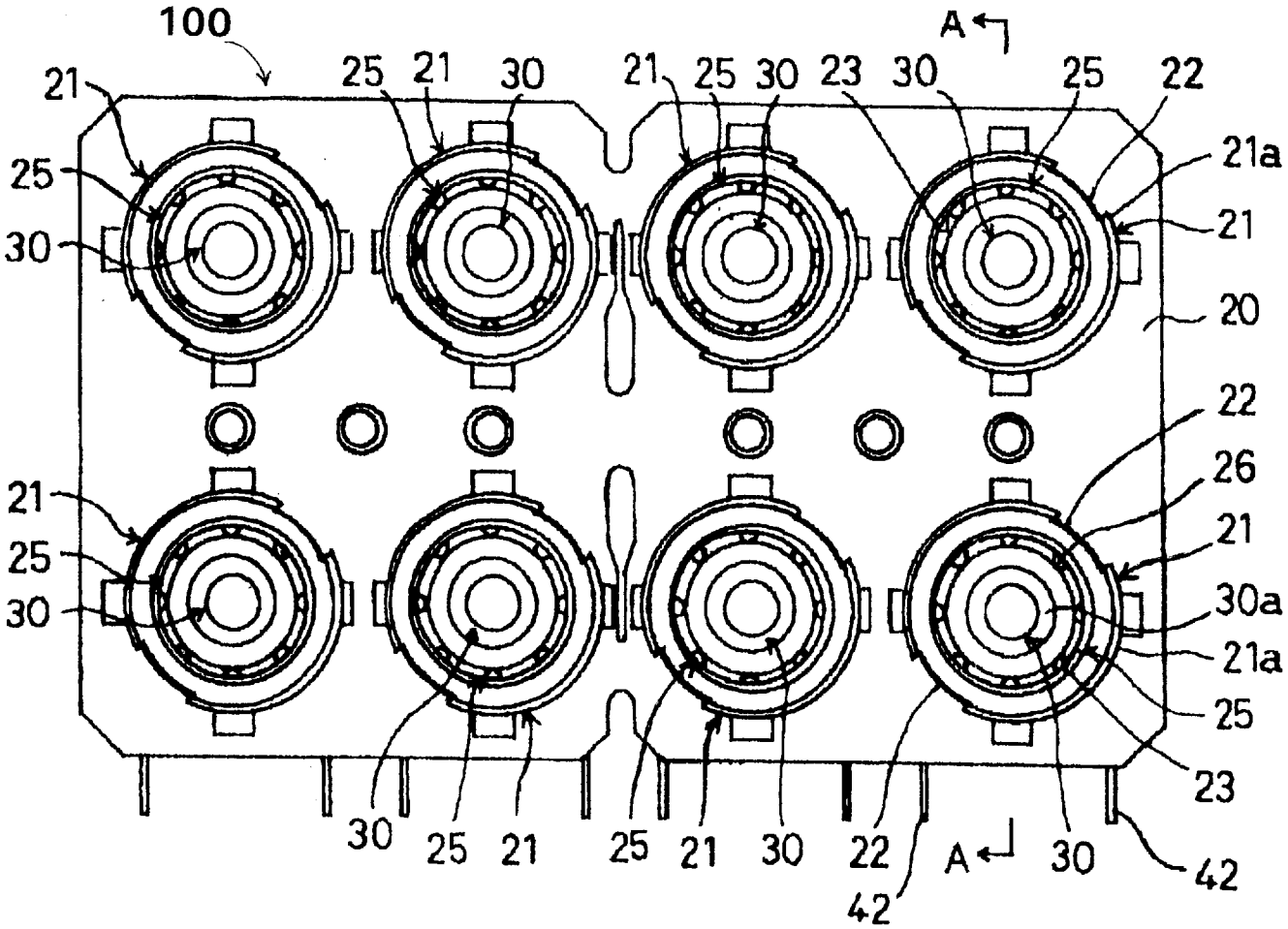
FIG. 2 is a top view of the first embodiment.

Additionally referring now to FIG. 2, showing an eight-gang multiple-threaded terminal device 100 generally in two rows. Each multiple-threaded terminal device 100 comprises the components as described above. Multiple-threaded threaded terminal device 100 has an outer edge beyond which distal portions of terminal sections 42 extend to enable electrical contact with external elements (not shown).

Figure 3:
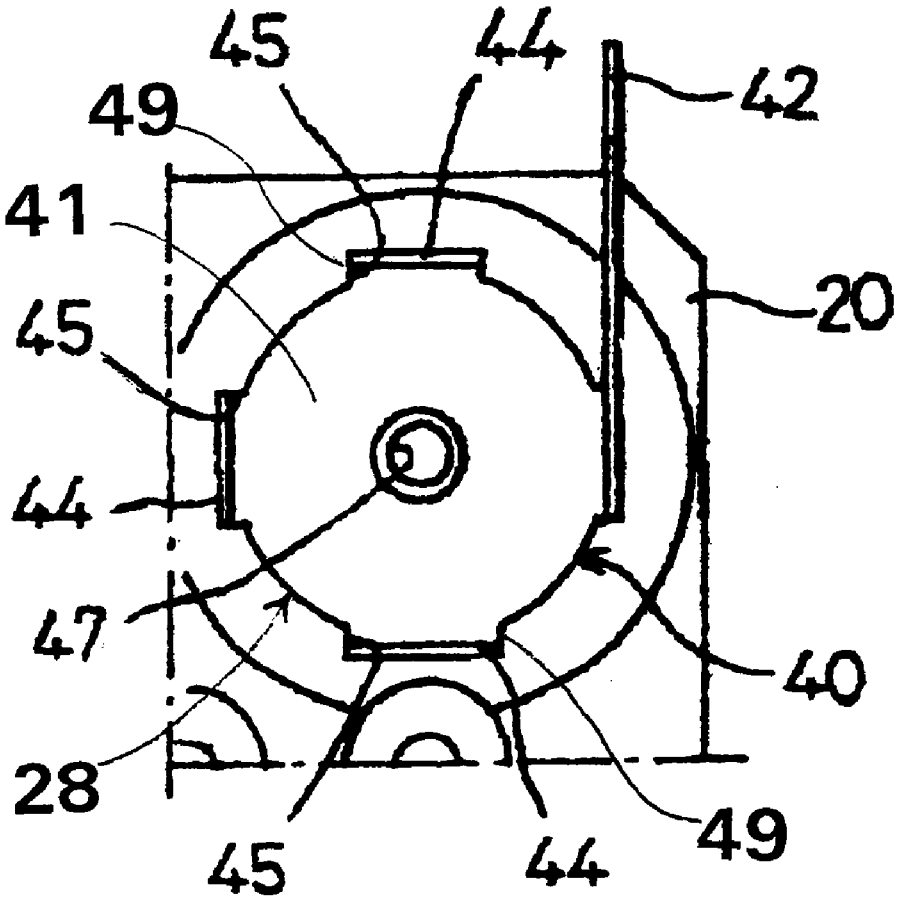
FIG. 3 is a partial bottom view of the first embodiment.

Additionally referring now to FIG. 3, showing the bottom view of one multiple-threaded terminal device 100. The front edge and sides of each recessed groove 45 receives and retains each corresponding guide portion 49 extending from terminal plate 41. As a result, terminal 40 is fixed within through hole 28 resists rotation relative to through hole 28. Here, terminal section 42 extends beyond the outer edge of multiple-threaded terminal device 100 to enable electrical connection to terminal 40.

Figure 4:
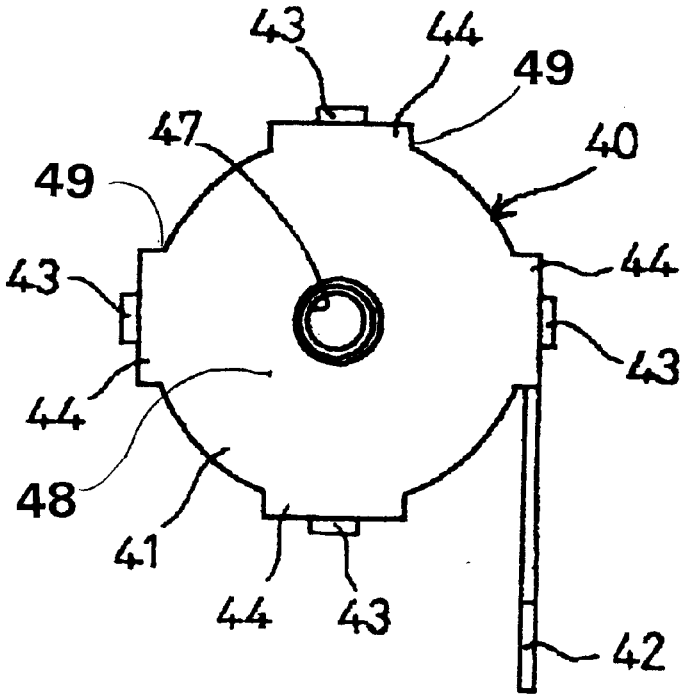
FIG. 4 is a top view of a terminal used in the first embodiment.
Figure 5:
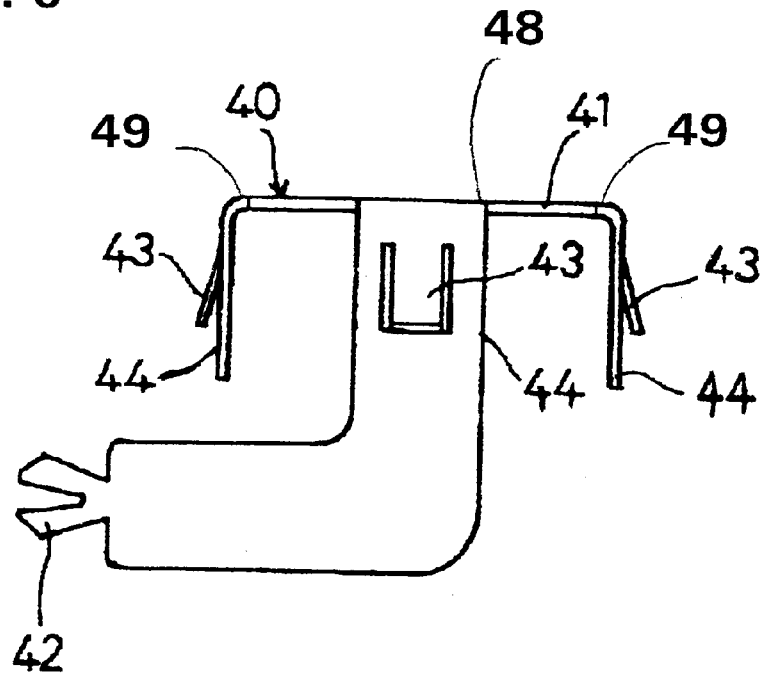
FIG. 5 is a side view of a terminal used in the first embodiment.

Additionally referring now to FIGS. 4 and 5, in this embodiment, four guide portions 49 are positioned around the outer rim of terminal plate 41. Each guide portion 49 extends horizontally from terminal plate 41 and is then folded perpendicular to terminal plate 41 to form folded pieces 44, as described above. Here, stopper pieces 43 are bent away from folded pieces 44 to engage stage portions 46, and fix each terminal 40 to each housing section 21. Terminal 40 is generally formed by punching and folding a conducive material.

Figure 6:
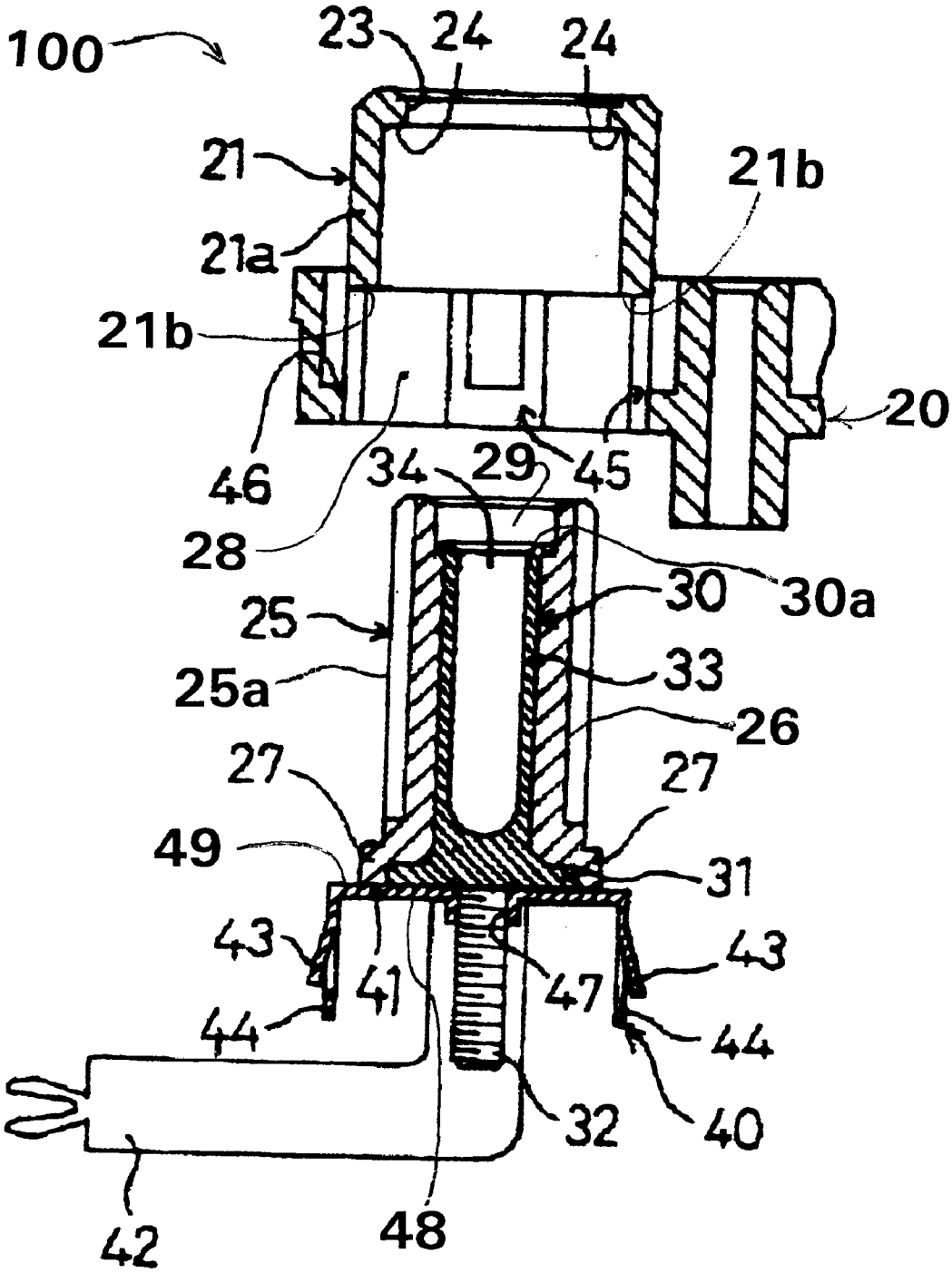
FIG. 6 is a sectional view showing an assembly step of the first embodiment.

Additionally referring now to FIG. 6, during assembly of a multiple-threaded terminal device 100, rotatable knob 25 and rod-shaped contact 30, with threaded shaft section 32, are integrated together by curl section 30*a* formed into plug insertion opening 29. Rotatable knob 25, is fully threaded into threaded hole 47 in terminal 40 and screwed towards contact portion 48 enabling the bottom face of lead-wire-pinching member 31 to connect to contact portion 48 of terminal 40.

Next the assembled unit, encompassing rotatable knob 25 and terminal 40, inserts into through hole 28, and is pressed towards the second surface of body plate 20. As the assembled unit is inserted into housing section 21, a top portion of cylindrical control section 25*a* projects through control-inserting-and-passing opening 23 and away from the first surface of body plate 20. Simultaneously, the outer rim of terminal plate 41 contacts stage sections 21*b*, surrounding through hole 28, thereby aligning the assembled unit to the central axis of housing section 21.

Additionally, guide portions 49 and folded pieces 44, guided by corresponding recessed grooves 45, allow the tips of stopper pieces 43, to elastically compress against recessed grooves 45. As the tips of stopper pieces 43 passes the horizontal surface of corresponding stage portions 46 elastic compression releases and stopper pieces expand into stage portions 46.

As a result the assembled unit, encompassing rotatable knob 25 and terminal 40 is fixed into body plate 20. Rotatable knob 25, with contact 30, is thus prevented from passing away from the first surface of body plate 20 by stopper projection 27 contacting either locking-control portion 24 or the top of terminal 40. As a further result, threaded shaft 32 maintains threaded engagement with threaded hole 47 through out its complete length.

During operation of the first embodiment of multiple-threaded terminal device 100, rotatable knob 25 is unscrewed away from terminal plate 41 forming a gap between the top of contact portion 48 and the bottom of lead-wire-pinching member 31. Electrically conductive lead wire 39 is then inserted through insert hole 22 into the gap thereby enabling electrical contact from either contact 30 or lead wire 39 to terminal section 42.

Figure 7:
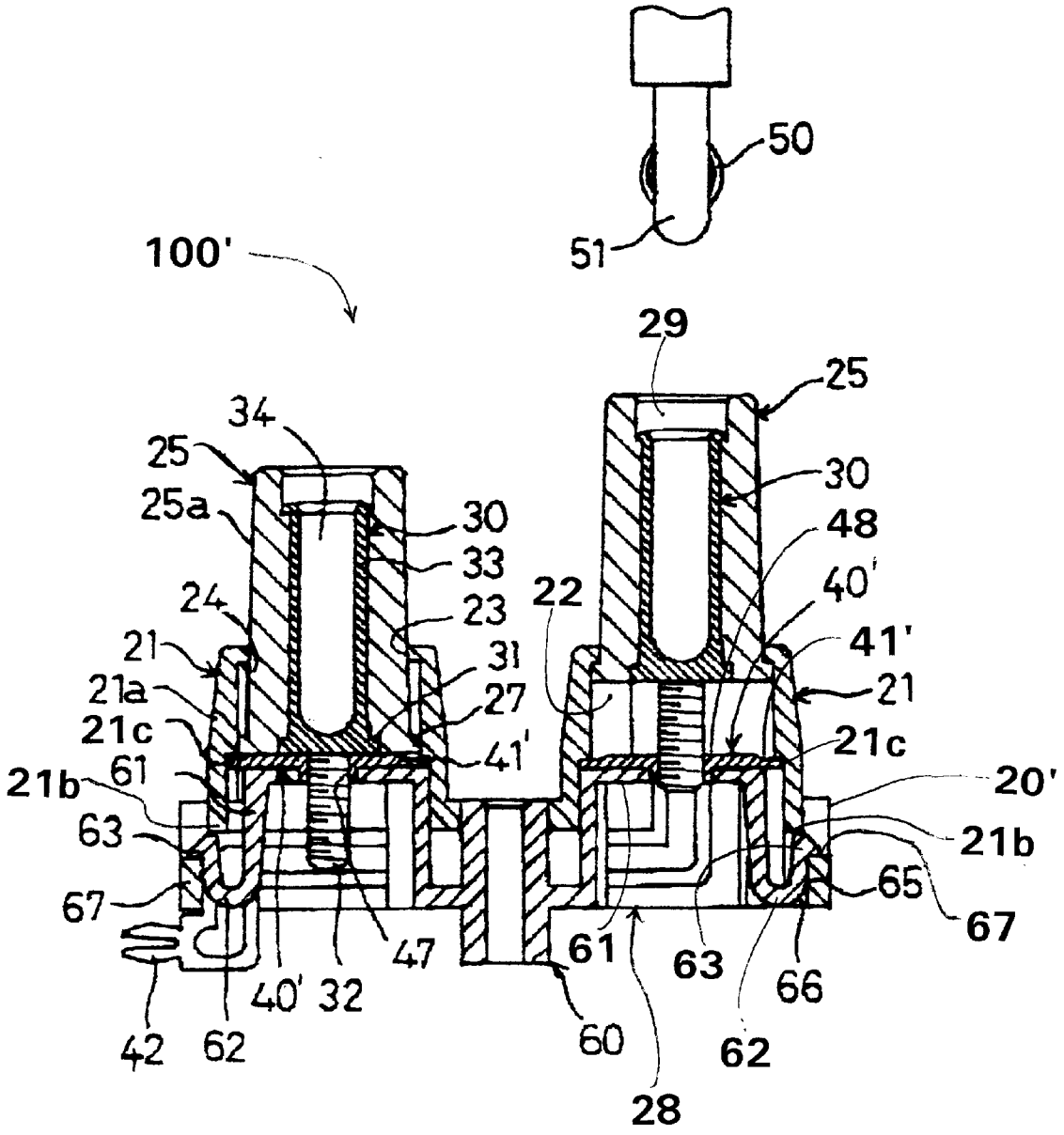
FIG. 7 is a sectional view, taken along line B—B in FIG. 8, of a second embodiment of a multiple-threaded terminal device.

Referring now to FIG. 7, a second embodiment of multiple-threaded terminal device 100', includes a terminal 40' mounted to a body plate 20'. Rotatable knob 25 is secured to terminal 40' by threaded shaft 32 threaded into threaded hole 47. As described in the first embodiment, rotatable knob 25 is fixed projecting away from contact 30, enabling screwing and unscrewing of threaded shaft 32. Plug-inserting hole 34, coaxial to contact 30 is formed to receive electrical contact from contact springs 50 of plug 51, thereby enabling electrical connection from plug 51 through contact 30 to terminal 40'.

Terminal 40' comprises a generally circular terminal plate 41' with terminal section 42 extending from an outer periphery. Terminal section 42 extends generally perpendicularly to terminal plate 41' and is formed to pass between the first and second surface of body plate 20' until reaching a peripheral edge of body plate 20'. At the peripheral edge of body plate 20', terminal section 42 is formed to extend below the second surface of body plate 20' to enable electrical contact, as described above. Around central threaded hole 47 is formed raised contact portion 48 to enable electrical contact between terminal 40' and rotatable knob 25 in a similar manner as the first embodiment. Terminal 40' is made from an electrically conductive substance, such as metal.

Housing sections 21 are formed on and project away from the first surface of body plate 20' each having a central axis. In the second embodiment, cylinder portion 21*a*, stage section 21*b*, insert hole 22, control-inserting and passing opening 23, and locking-control portion 24 are all positioned along an interior dimension of housing section 21. Within housing section 21, between cylinder portion 21*a* and stage section 21*b*, is formed an intermediate plate section 21*c*. Terminal plate 41', of terminal 40, contacts plate section 21*c* thereby aligning terminal plate 41' perpendicular to the central axis of housing section 21. Stage sections 21 contact portions of a rear cover 60 and align rear cover 60 to the second surface of body plate 20', as will be explained.

Rear cover 60, molded from a synthetic resin material, has integrally formed terminal-supporting projections 61 each supporting and fixing terminals 40' against respective stage sections 12*b*. Terminal-supporting projections 61 project away from a top surface of rear cover 60 and contact the bottom surface of terminal plate 41. Terminal-supporting projections 61 have a centrally located hole(not shown) that allows threaded shaft 32, of rotatable knob 25, to adjust relative to threaded hole 47 during operation.

At an outer periphery of rear cover 60, positioned perpendicular to the second surface of body plate 20', are formed U-shaped spring pieces 62, each having a tip side and an engaging claw 63. The tip side of each spring piece 62 is chamfered relative to the top surface of rear cover 60 to enable elastic engagement of engaging claw 63 with body plate 20', as will be explained.

A peripheral frame 65, of body plate 20', is formed around body plate 20' extending perpendicular to the second surface of body plate 20'. Peripheral frame 65 has a plurality of recessed grooves 66, each with corresponding stage sections 67. Stage sections 67 are formed at a bottom portion of each recessed groove 66. Each stage section 67 is formed perpendicular to the second surface of body plate 20' and engages with engaging claws 63 of rear cover 60. Engaging claws 63 fix rear cover 60 to body plate 20' and retain terminal plates 41' against corresponding plate sections 21*c*, thereby retaining rotating controls 25 within housing sections 21.

Figure 8:
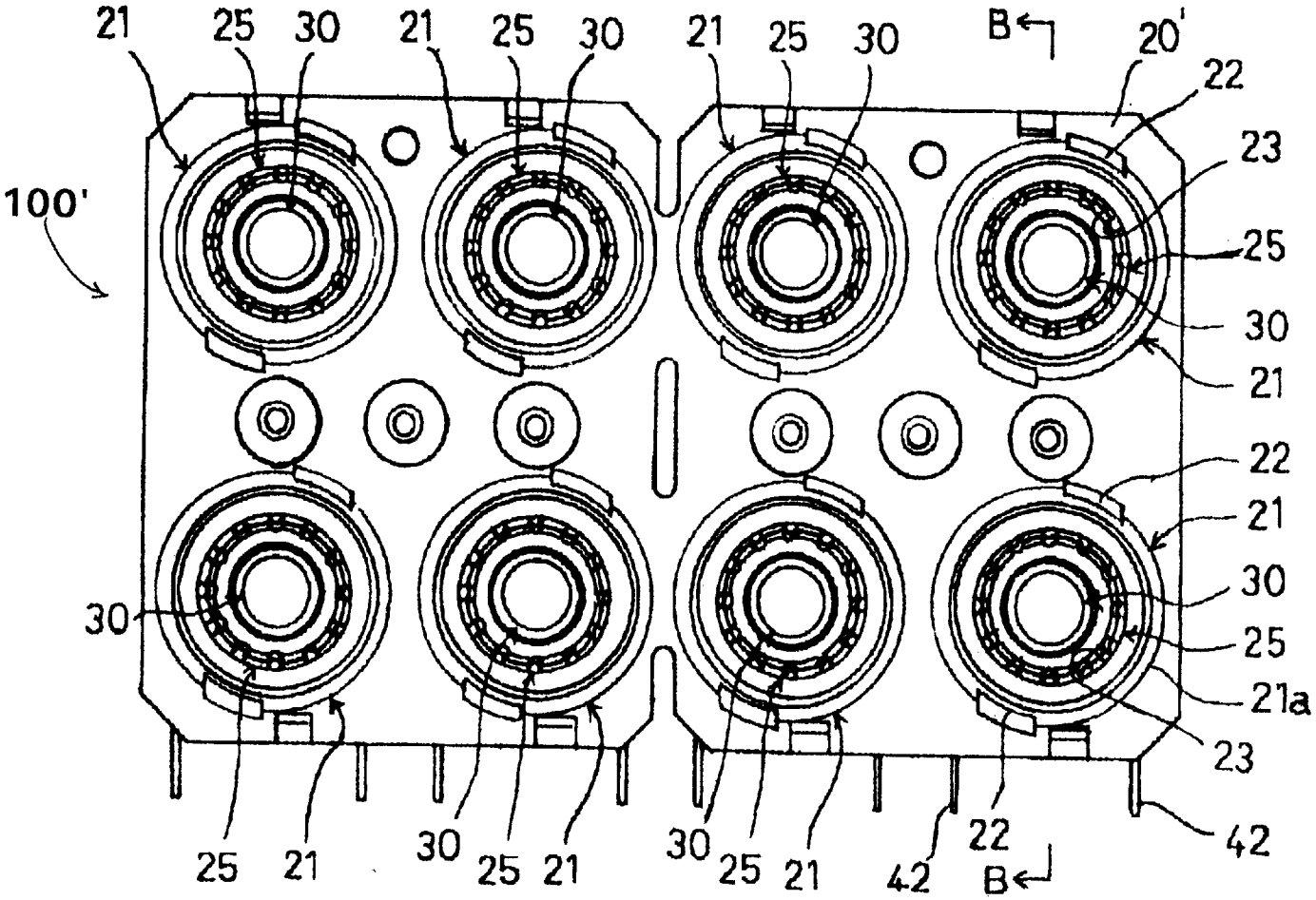
FIG. 8 is a top view of the second embodiment.

Additionally referring now to FIG. 8, eight-gang multiple-threaded terminal devices 100' are positioned in two row. Each multiple-threaded terminal device 100' comprises the components as described above. Each eight-gang multiple-threaded terminal device 100' has an outer edge beyond which distal terminal sections 42 extend to enable electrical contact with external elements (not shown).

Figure 9:
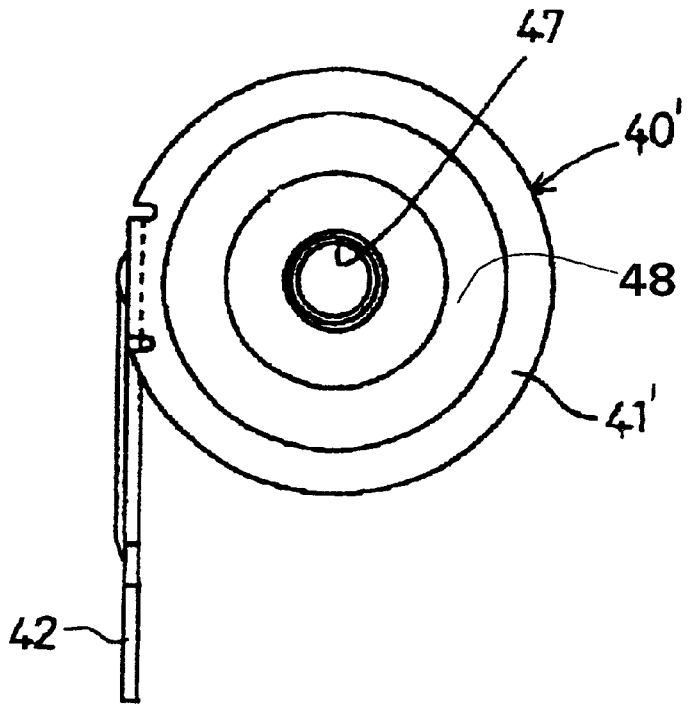
FIG. 9 is a top view of a terminal used in the second embodiment.
Figure 10:
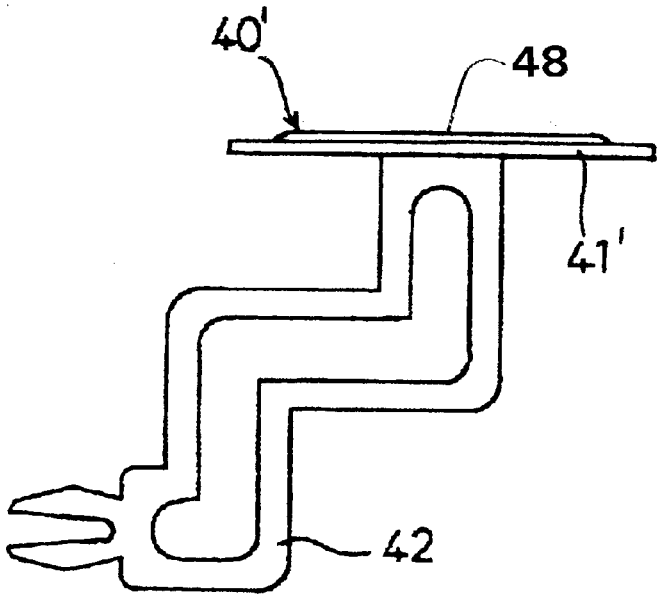
FIG. 10 is a side view of the terminal used in the second embodiment.

Additionally referring now to FIGS. 9 and 10, terminal 40' includes terminal plate 41', containing contact portion 48 and central threaded hole 47. Extending perpendicularly from a peripheral rim of terminal plate 41' is terminal section 42. Terminal section 42 is shaped to fit within a bottom portion of through hole 28 and extend between the first and second side of body plate 20' to minimize the height of multiple-threaded terminal device 100'.

Figure 11:
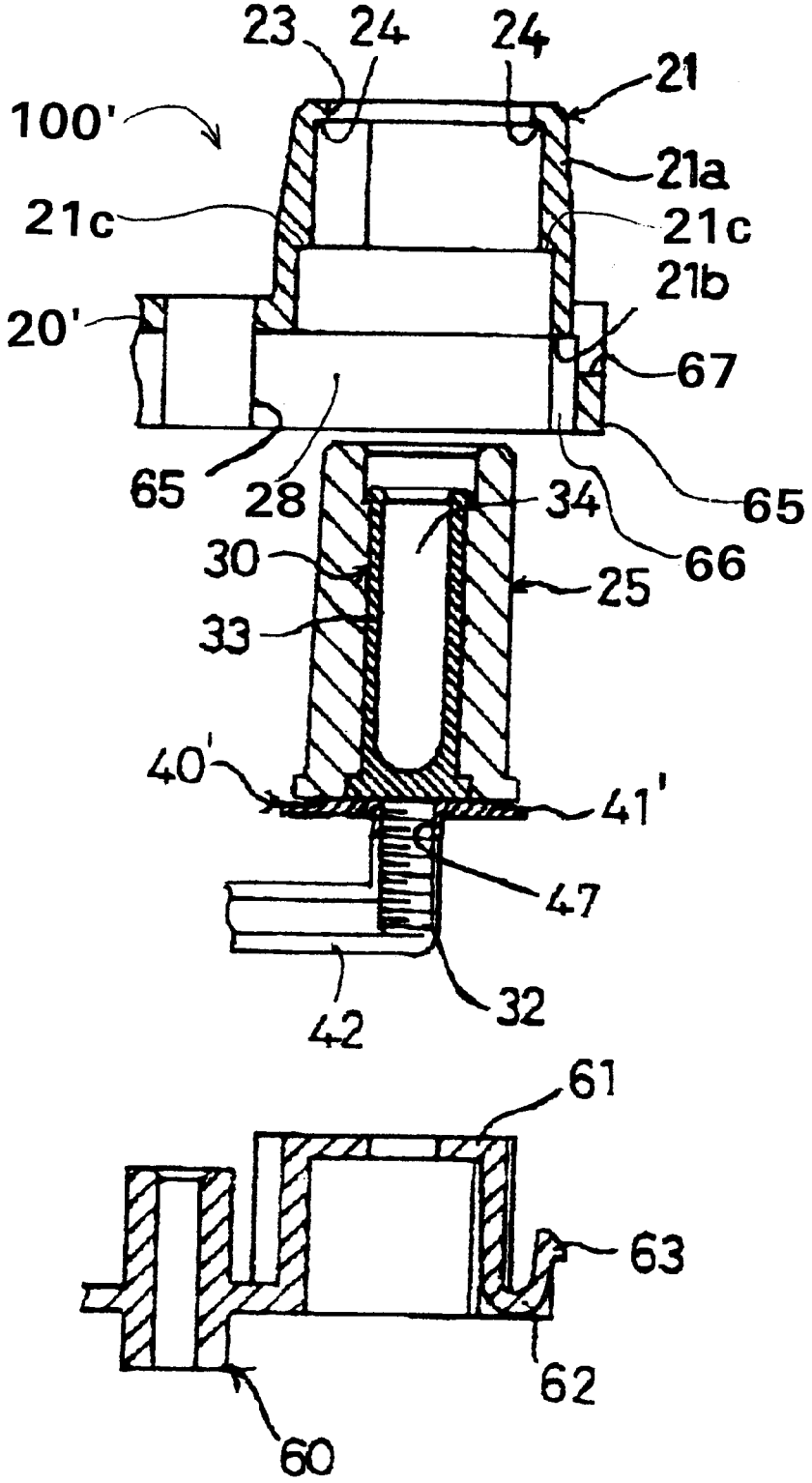
FIG. 11 is a sectional view showing an assembly step in the second embodiment.

Additionally referring now to FIG. 11, during assembly of the second embodiment of multiple-threaded terminal device 100', rotatable knob 25 and rod-shaped contact 30 are integrated by means of curl-clamping or swaging, as described above. Next, threaded shaft section 32, of contact 30, is threaded into threaded hole 47 until the bottom portion of lead-wire-pinching member 31 contacts contact portion 48.

The assembled terminal plate 41' and rotatable knob 25 are inserted into housing section 21 of body plate 20'. Insertion continues until the outer rim of terminal plate 41' contacts plate section 21*c* thereby aligning terminal plate 41' and rotatable knob 25 to the body plate 20'.

Next, rear cover plate 60, with terminal supporting projections 61, is aligned with terminals 41' and pressed towards the first surface of body plate 20' until engaging claws 63 enter recessed grooves 66. As engaging claws 63 contact peripheral frame 65 of body plate 20' spring pieces 62 elastically compress and then snap into contact with corresponding stage sections 67. As a result, rear cover plate 60 is replaceably fixed to body plate 20' and supporting projection 61 fixes the outer rim of terminal plate 41' to stage section 21*b* thereby securing rotatable knob 25 within housing section 21.

Figure 12:
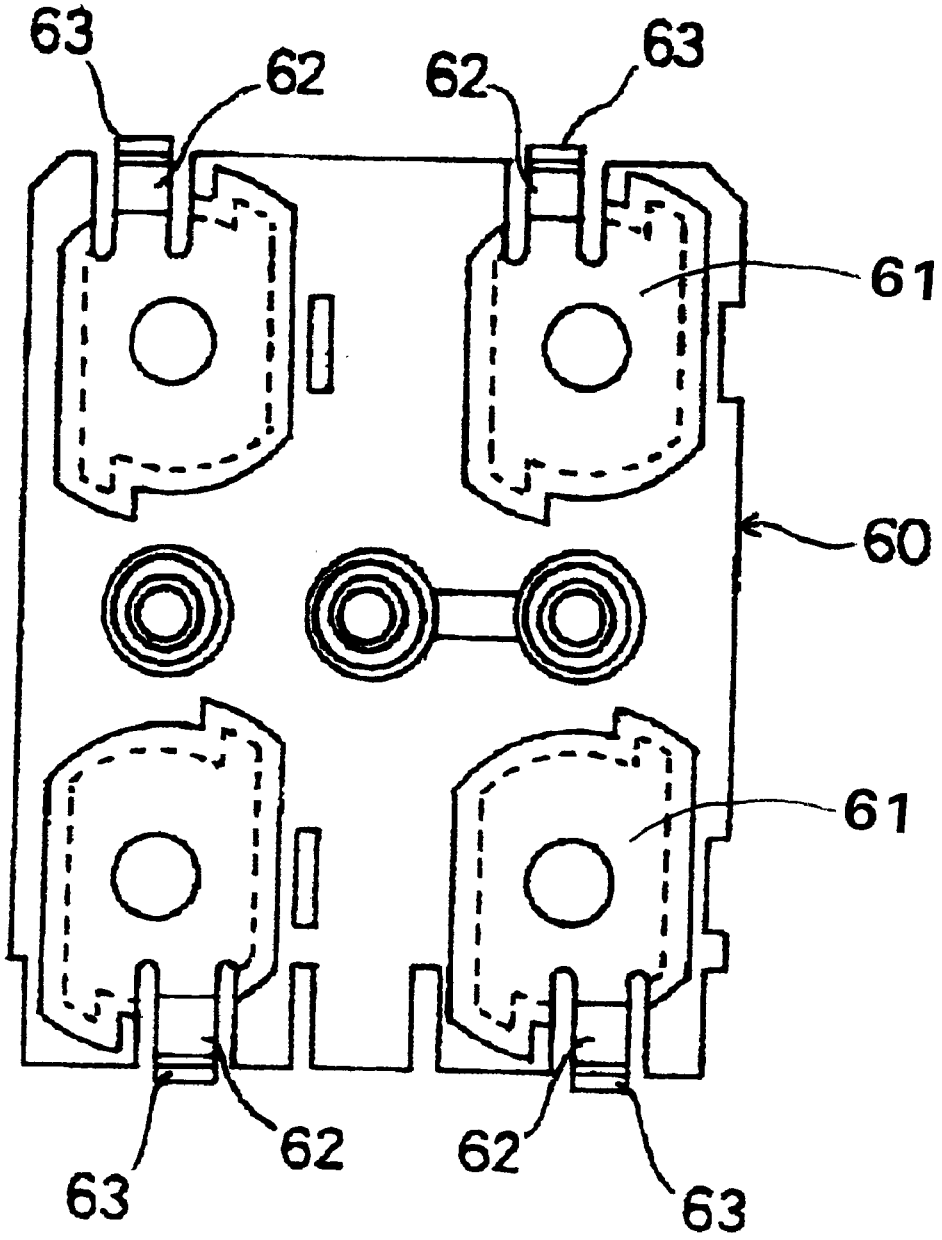
FIG. 12 is a top view of the rear cover used in the second embodiment.

Now additionally referring to FIG. 12, in the second embodiment, rear cover plate 60 generally has a four-gang configuration, as shown. A four-gang configuration allows four sets of terminals 40' with rotating knobs 25 to be installed and fixed into body plate 20' simultaneously by one rear cover 60. Additional embodiments of rear cover 60 may also be formed in two-gang or other configurations depending upon manufacturer or customer need. After assembly, the second embodiment of multiple-threaded terminal device 100' is operated in the same manner as in the first embodiment.

Figure 13:
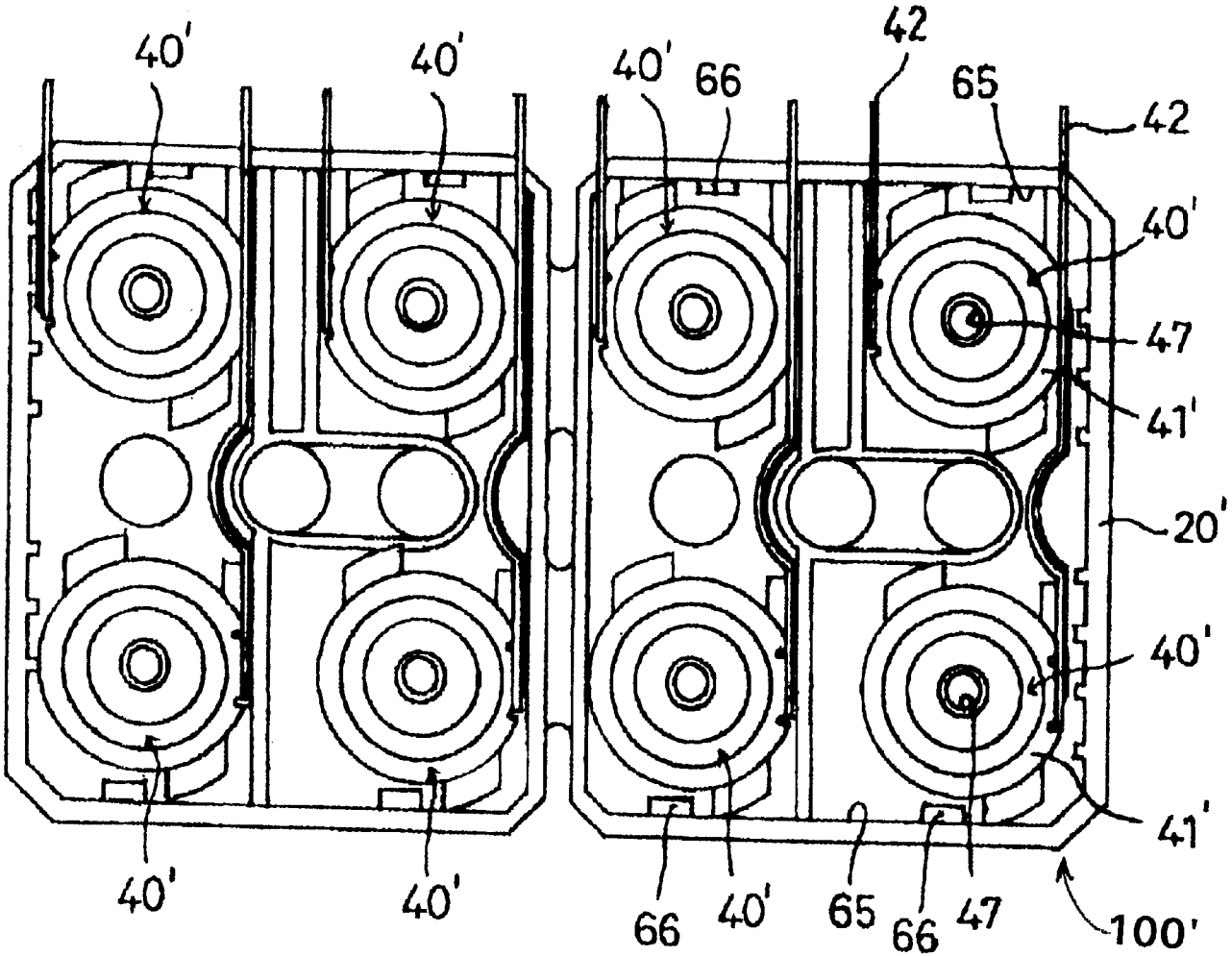
FIG. 13 is a partial bottom view of the second embodiment showing the rear cover removed.
Figure 14:
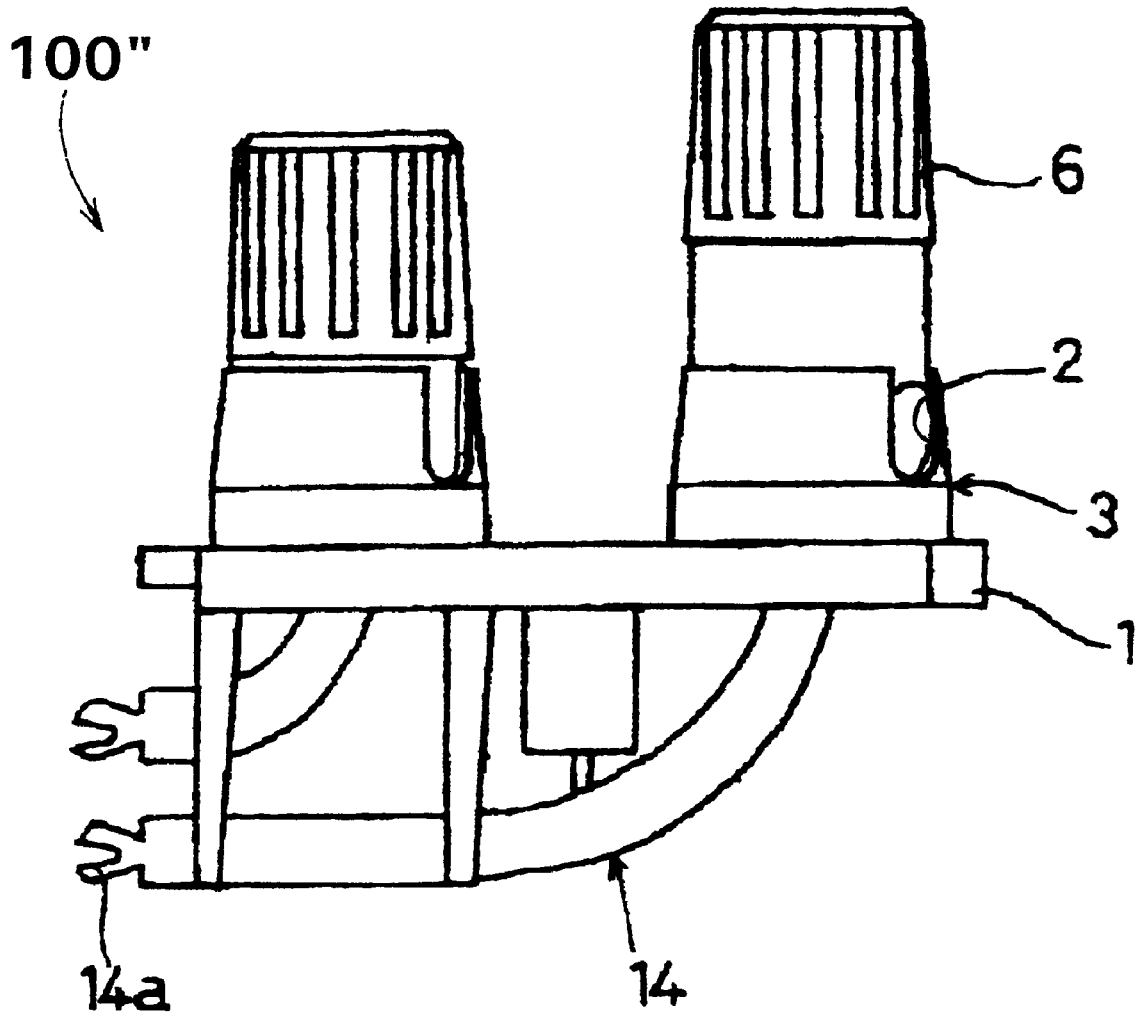
Fig. 14 PRIOR ART
FIG. 14 is a side view of the conventional multiple-threaded terminal device.
Figure 15:
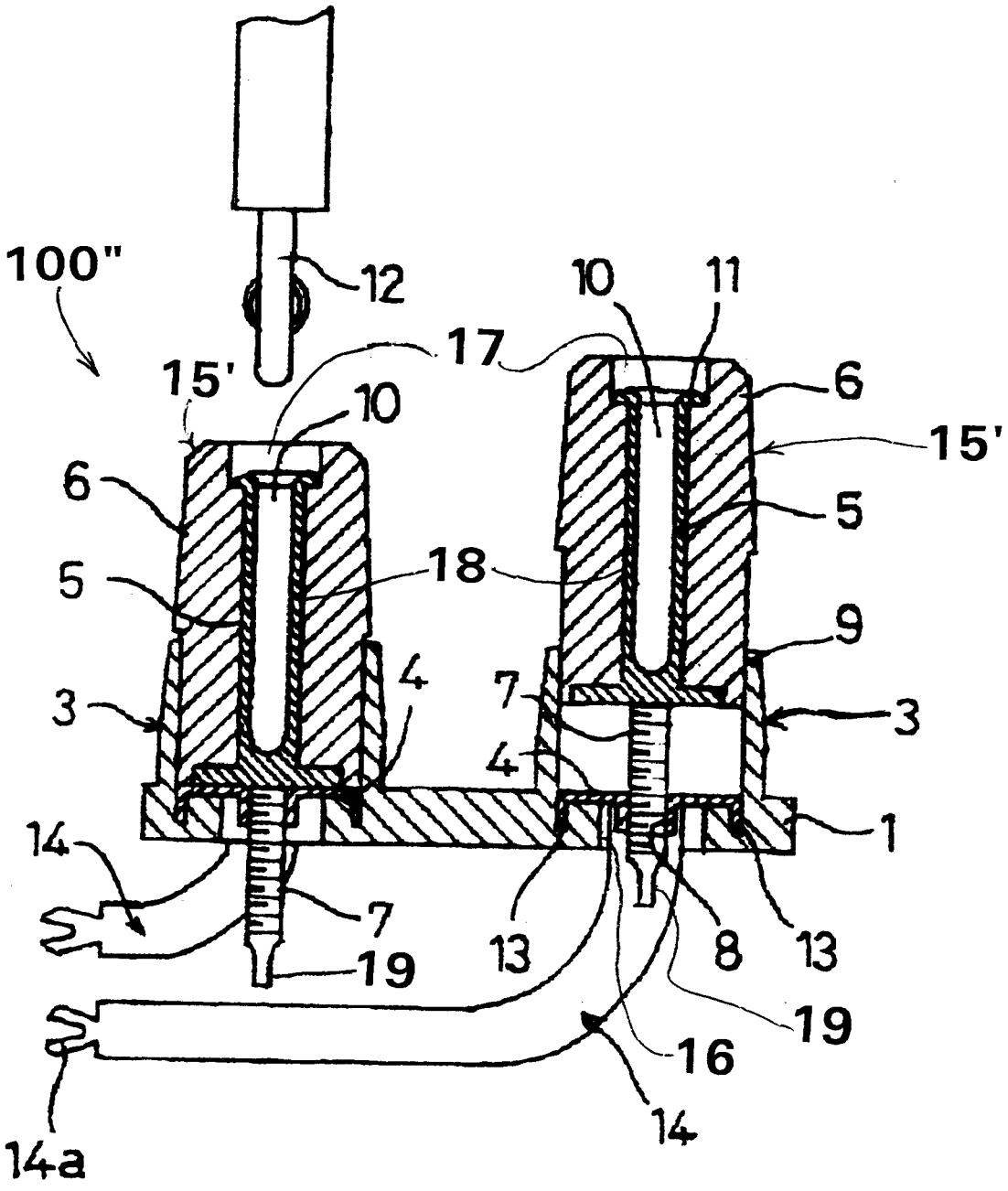
Fig. 15 PRIOR ART
FIG. 15 is a vertical sectional view of the conventional multiple-threaded terminal device.
Figure 16:
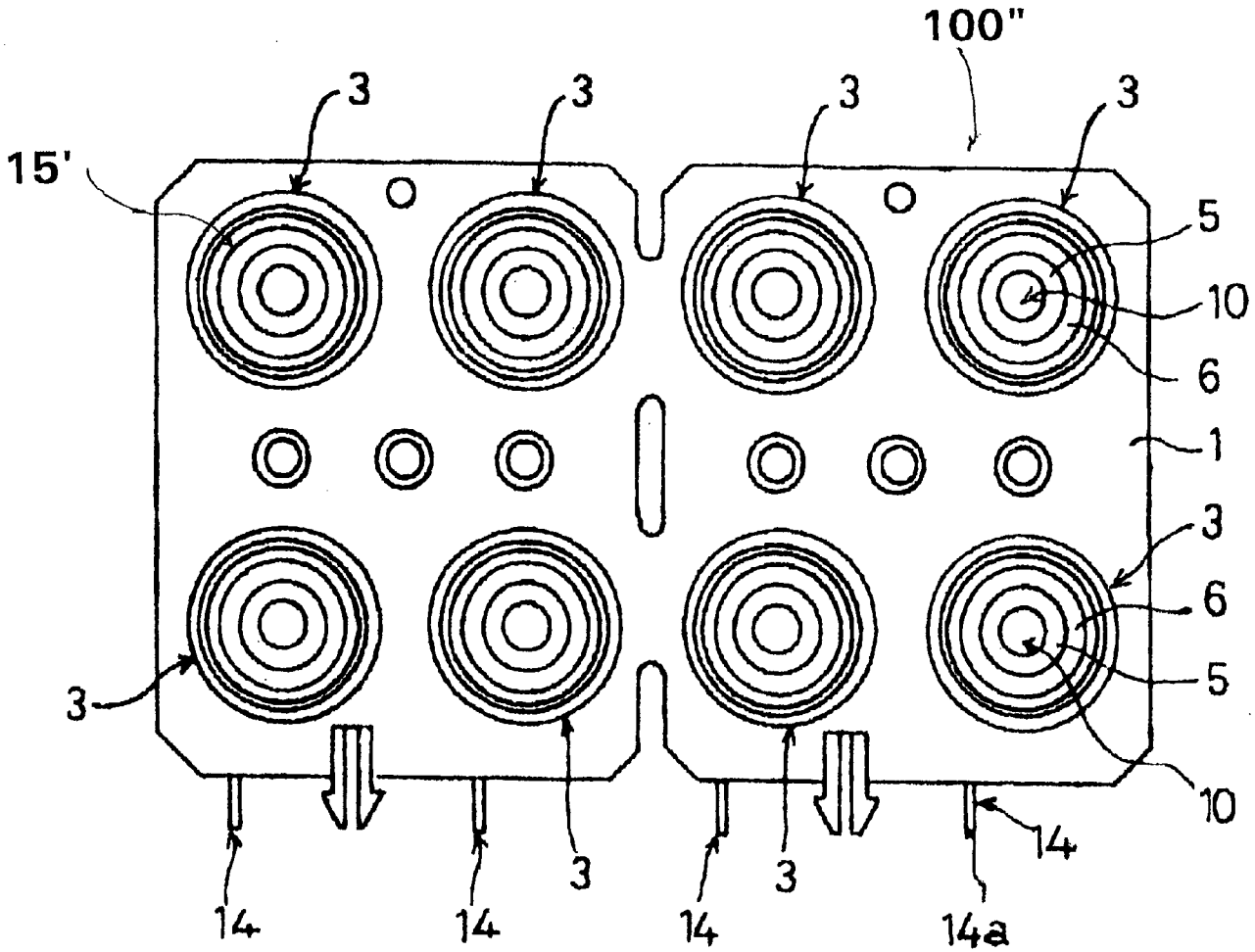
FIG. 16 is a top view showing a conventional multiple-threaded terminal device.

Now additionally referring to FIG. 13, the second embodiment of multiple-threaded terminal device 100' may be in either a four-gang configuration (not shown) or an eight-gang configuration (shown). Here, the distal ends of terminal sections 42, extending from corresponding terminal plates 41, advance through body plate 20' and beyond peripheral frame 65 to facilitate electrical connection. As shown, an eight-gang configuration is subdivided into two linked four-gang configurations, each formed to receive a single four-gang rear cover 60. Other embodiments may include additional four-gang, two-gang or other configurations depending upon manufacturer or customer need.

The present embodiments offer several positive points.

First, since contact 30 with rotatable knob 25 are secured between cylindrical housing section 21 and fixed terminal 40, 40' the need for a crushing operation to lock threaded shaft section 32 into terminal 40, 40' is eliminated, thus simplifying assembly operation and reducing accidental damage.

Second, cylindrical housing sections 21 and through holes 28 enable insertion of assembled contacts 30 and terminals 40, 40' thus simplifying assembly steps and lowering manufacturing time.

Third, assembly of contacts 30 and terminals 40, 40' into body plates 20, 20' from the second surface of body plates 20, 20' allows both threaded shaft sections 32 and terminal sections 42 to remain generally close to or under the second surface. As a result, the overall thickness of an assembled multiple-threaded terminal device 100 is reduced and maintained in a compact shape thus responding to customer demand.

Fourth, in the first embodiment, terminal plate 40 has four opposing stopper pieces 43 each individually engaging stage portions 46 on body plate 20. As a result, assembly of each terminal plate 40 into body plate 20 is accelerated since four stopper pieces 43 evenly distribute force around insertion hole 28 thus reducing the force necessary to fix terminal 40 to body plate 20 and reducing the risk of damage.

Fifth, in the second embodiment, terminal 40' is fixed in place by rear cover 60. As a result, using the four-gang rear cover 60, four terminals 40' may be simultaneously fixed into body plate 20' thus speeding assembly and reducing work time.

Sixth, in the second embodiment, simplified terminal 40' is formed from an electrically conductive material, such as metal. Raw material costs for metal are generally higher per unit than the raw material costs for the synthetic resin material used to form rear cover 60. As a result, simplified terminals 40' requires less expensive raw material and manufacturing costs are reduced.

Seventh, in the second embodiment, terminal section 42 passes between the top and bottom surfaces of body plate 20 until a distal end reaches a perimeter of body plate 20. As a result, multiple-threaded terminal connector 100' is made thinner and terminal section 42 is protected from damage during assembly and repair.

Although only a single or few exemplary embodiments of this invention have been described in detail above, those skilled in the art will readily appreciate that many modifications are possible in the exemplary embodiment(s) without materially departing from the novel teachings and advantages of this invention. Accordingly, all such modifications are intended to be included within the scope of this invention as defined in the following claims. In the claims, means-plus-function clauses are intended to cover the structures described herein as performing the recited function and not only structural equivalents but also equivalent structures. Thus although a nail and screw may not be structural equivalents in that a nail relies entirely on friction between a wooden part and a cylindrical surface whereas a screw's helical surface positively engages the wooden part, in the environment of fastening wooden parts, a nail and a screw may be equivalent structures.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. A multiple terminal device comprising:

a body plate;

said body plate including at least one rotatable knob projecting from a first surface;

said body plate including a housing section surrounding said knob and extending away from said first surface;

said knob including a control;

said control including means for attachment to a first external element;

said means for attachment being disposed on a first end of said control;

said control including means for adjustment relative to said first external element;

said means for adjustment being disposed on a second end of said control; and said body plate including means for aligning and fixing said first external element to said body plate between said first surface and a second surface.

2. A multiple-threaded terminal device according to claim 1, wherein:

said adjustment means includes a control section;

said control section containing at least one non-slip groove; and said non-slip groove enabling manual adjustment of said control section relative to said first external element.

3. A multiple threaded terminal device, comprising:

a body plate;

said body plate including at least one rotatable knob projecting from a first surface;

said body plate including a housing section surrounding said knob and extending away from said first surface;

said knob including a control;

said control including means for attachment to a first external element;

said means for attachment being disposed on a first end of said control;

said control including means for adjustment relative to said first external element;

said means for adjustment being disposed on a second end of said control;

said body plate including means for aligning and fixing said first external element to said body plate between said first surface and a second surface;

said means for aligning and fixing includes at least one recessed groove and at least one stage section and at least one stage portion;

said recessed groove between said first and said second surfaces being parallel to said control;

said recessed groove engaging at least one guide portion formed on said first external element to prevent rotation of said first external element relative to said first surface;

said stage section formed intermediate to said recessed groove and said first surface parallel to said first surface;

said stage section engaging a top portion of said first external element to align said first external element relative to said first surface;

said stage portion formed intermediate to said recessed groove and said second surface parallel to said second surface; and said stage portion engaging a stopper portion of said first external element to fix said first external element in said body plate.

4. A multiple-threaded terminal device comprising:

a terminal;

said terminal including a terminal plate;

said terminal plate including a threaded portion permitting threaded attachment to a first external element;

said terminal including at least one guide portion extending horizontally from said terminal plate;

said guide portion providing flanged contact to a second external element;

said flanged contact aligns said terminal to said second external element;

said guide portion also including at least one fixed piece extending perpendicular to said terminal plate;

said fixed piece including an elastic stopper piece;

said stopper piece elastically fixes said terminal to said second external element and retains said terminal within said second external element;

said at least one fixed piece extending away from said second external element to a distal end; and said distal end enabling electrical connection from said first external element through said terminal to said distal end.

5. A multiple-threaded terminal device comprising:

a body plate;

said body plate having a through hole extending from a first surface to a second surface and engaging a first external element;

at least one recessed groove formed between said first and said second surfaces perpendicular to said first surface resists relative rotation of said first external element relative to said body plate;

at least one stage section formed between said recessed groove and said first surface parallel to said first surface aligns said first external element to said first surface; and at least one stage portion affixed to said body plate fixes said first external element parallel to said first surface.

6. A multiple-threaded terminal device comprising:

a body plate;

said body plate having a first surface and a second surface;

said body plate including at least one housing section surrounding a through hole and extending away from said first surface;

said housing section includes a plate section within said housing section;

said plate section aligning a first external element parallel to said first surface;

said first external element threadably engaging a rotating control;

at least one stage section formed between said first and second surfaces parallel to said first surface;

said stage section aligning a second external element to said first external element and to said body plate;

said body plate includes a frame portion between said first and said second surface;

said frame portion includes at least one stage portion; and said stage portion replaceably fixes said second external element to said body plate thereby fixing said first external element in said housing section.

7. A multiple-threaded terminal device according to claim 6 wherein said first external element further comprises:

a terminal;

said terminal including a terminal plate having a rim portion;

said terminal plate including a threaded portion for threadably engaging a rotating control;

a terminal section extending from said terminal plate;

said terminal section extending between said first surface and said second surface to said peripheral frame; and said terminal section enabling electrical connection from said terminal section through said terminal plate to said rotating control.

8. A multiple-threaded terminal device according to claim 6 wherein said second external element further comprises:

a rear cover;

said rear cover including at least one supporting projection;

said supporting projection extending into said housing section to support said first external element away from said first surface;

said rear cover including at least one spring piece;

said spring piece extends away from said rear cover in an elastic form;

said spring piece extending in an engaging portion perpendicular to said rear cover;

said engaging portion snaps into said stage portion and retains said supporting projection within said housing section to fix said first external element within said body plate; and said rear cover allowing terminal portions of said first external element to pass between said first and said second surface to an outer edge of said body plate.

9. A multiple-threaded terminal device comprising:

a body plate;

said body plate including a plurality of rotatable knobs projecting from a first surface;

each said rotatable knob including a contact therein;

each of said contacts including an intermediate lead-wire pinching member;

means on a first end of said contacts for adjustable attachment to a first external element;

each of said contacts including a grooved control section on a second end for operator adjustment relative to said first external element;

each said contact including means on said second end for attachment to a second external element;

said body plate including a generally circular housing section surrounding each said contact and extending away from said first surface;

each said housing section having a first preventative means formed on a top radius parallel to said first surface; and said first preventative means engaging a second preventative means formed on each said contact thereby preventing passage of said contact away from said first surface.

10. A multiple-threaded terminal device according to claim 9 wherein:

each said housing section surrounds a through hole extending through said body plate from said first surface to a second surface;

each said housing section and each said through hole having a common central axis through said body plate;

each said housing section including an alignment portion formed on an interior surface about said central axis;

said housing sections receive said rotating controls and said first external elements through said second surface; and said alignment portions align said first external elements to said body plate.

11. A multiple-threaded terminal device according to claim 10, wherein:

each said first external element is a terminal;

said terminal including a terminal plate having a threaded portion permitting threaded attachment to said rotating control;

said terminal having a plurality of guide portions extending into said body plate and aligning with said alignment portions;

said terminal having integral stopper pieces formed in a periphery there of perpendicular to said terminal plate;

said body plate having stage portions formed in each said through hole below each said housing section; and said stopper pieces snapping into said stage portions to fix each said terminal and each said rotating control in said housing section.

12. A multiple-threaded terminal device according to claim 10, wherein:

each said first external element is a terminal;

said terminal including a terminal plate having a threaded portion permitting threaded attachment to said rotating control;

said terminal plate aligning with said alignment portions;

said body plate having a peripheral rim formed perpendicular to said first surface;

said peripheral rim including stage sections formed parallel to said first surface;

a rear cover;

said rear cover including at least one supporting projection and at least one spring piece containing an engaging claw;

said supporting projection supporting said terminal against said alignment portions; and said engaging claws fixing said rear cover to said body plate to retain said rotating control within said housing section.

13. A multiple-threaded terminal device comprising:

a contact;

means on a first end of said contact for attachment to a first external element;

means on said second end of said contact for attachment to a second external element;

a control portion formed around said second end of said contact;

said control portion having an exterior surface;

at least one groove portion on said exterior surface of said control portion;

said groove portion enabling manual manipulation of said contact relative to said first external element;

a first preventative means on said second external element about said second end of said contact;

a second preventative means on a radius of said second end of said contact; and said first preventative means engaging said second preventative means effective to prevent passage of said contact away from said second external element.

14. A multiple terminal device comprising:

a body plate;

said body plate including at least one rotatable knob projecting from a first surface;

said body plate including a housing section surrounding said knob and extending away from said first surface;

said knob including a control;

said control including means for attachment to a first external element;

said means for attachment being disposed on a first end of said control;

said control including means for adjustment relative to said first external element;

said means for adjustment being disposed on a second end of said control;

said body plate including means for aligning and fixing said first external element to said body plate between said first surface and a second surface;

said means for aligning and fixing includes at least one recessed groove and at least one stage section and at least one stage portion;

said recessed groove between said first and said second surfaces being parallel to said control;

said recessed groove engaging at least one guide portion formed on said first external element to prevent rotation of said first external element relative to said first surface;

said stage section formed intermediate to said recessed groove and said first surface;

said stage section parallel to said first surface;

said stage section engaging a top portion of said first external element to align said first external element relative to said first surface;

said stage portion formed intermediate to said recessed groove and said second surface;

said stage portion parallel to said second surface; and said stage portion engaging a stopper portion of said first external element to fix said first external element in said body plate.

* * * * *